US008199920B2

(12) United States Patent
Valenti, III

(10) Patent No.: US 8,199,920 B2
(45) Date of Patent: Jun. 12, 2012

(54) PERSONAL COMPUTER BASED AUDIO FREQUENCY IMPEDANCE ANALYZER

(75) Inventor: Joseph Leo Valenti, III, Longmont, CO (US)

(73) Assignee: Unisyn Medical Technologies, Inc., Golden, CO (US)

( * ) Notice: Subject to any disclaimer, the term of this patent is extended or adjusted under 35 U.S.C. 154(b) by 844 days.

(21) Appl. No.: 12/337,317

(22) Filed: Dec. 17, 2008

(65) Prior Publication Data

US 2010/0150358 A1 Jun. 17, 2010

(51) Int. Cl.
*H04R 29/00* (2006.01)

(52) U.S. Cl. ..... 381/58

(58) Field of Classification Search ..... 381/58–61, 381/312

See application file for complete search history.

(56) References Cited

U.S. PATENT DOCUMENTS 6,269,318 B1 * 7/2001 Geddes ..... 702/109
2008/0144847 A1 * 6/2008 Chen et al. ..... 381/58

OTHER PUBLICATIONS

Ivchenko, Vladimir G. et al., "High-Speed Digitizing of Repetitive Waveforms Using Accurate Interleaved Sampling," IEEE Transactions on Instrumentation and Measurement, vol. 56, No. 4, pp. 1322-1328, Aug. 2007.

* cited by examiner

*Primary Examiner* — Benjamin Sandvik
*Assistant Examiner* — Whitney T Moore
(74) *Attorney, Agent, or Firm* — Marsh Fischmann & Breyfogle LLP

(57) ABSTRACT

An apparatus, method, and system for analyzing the response of a device under test using a signal generated by an audio card comprises a housing. The apparatus comprises a first connector coupled to the housing and configured to couple electrically with an output of the audio card and to receive a first signal from the audio card. The apparatus also comprises a second connector being electrically coupled with the first connector and configured to interface with the device under test in order to transmit the first signal to a device under test. The apparatus also comprises a third connector configured to receive a second signal from the device under test. The apparatus also comprises a fourth connector being electrically coupled with the third connector and configured to transmit the second signal to an input of the audio card.

23 Claims, 7 Drawing Sheets

PERSONAL COMPUTER BASED AUDIO FREQUENCY IMPEDANCE ANALYZER

BACKGROUND

This disclosure relates in general to device under test ("DUT") analyzers and, but not by way of limitation, to audio frequency impedance analyzers among other things.

Scalar and network analyzers are important tools in testing electrical devices and components. They can be used to measure and characterize the response of devices or components at different electromagnetic frequencies. This allows for a better understanding of how a device or component works.

However, scalar and network analyzers can be expensive. While there are inexpensive ways to test the response of electrical devices or components, they can often be prone to error and can be tedious to use.

There is a need for inexpensive network analyzers that are fast, accurate, and provide high resolution data.

BRIEF SUMMARY

Embodiments are thus related to an inexpensive apparatus, method, and system for analyzing the response of a device under test to a signal generated by a sound card. In some embodiments, an apparatus for analyzing the response of a device under test using a signal generated by an audio card is provided comprising a housing along with a series of connectors. The apparatus is known herein as a Z box. In some embodiments, a Z box is designed to be easily connected to a sound or audio card of a computer. This allows a Z box to receive signals from the sound card and then transmit resulting signals back to the sound card. A first connector may be coupled to a Z box housing and configured to couple electrically with an output of the audio card and to receive a first signal from the audio card. A second connector may be electrically coupled with the first connector and configured to interface with the device under test in order to transmit the first signal to the device under test. A third connector may be configured to receive a second signal from the device under test. A fourth connector may be electrically coupled with the third connector and configured to transmit the second signal to an input of the audio card. In some embodiments, the second connector and the third connector may further comprise a four wire Kelvin configuration.

In some embodiments, a Z box further comprises a transformer electrically coupled with the first connector in order to isolate a Z box. In some embodiments, a Z box further comprises an amplifier electrically coupled with the first connector in order to amplify a signal.

In some embodiments, a Z box comprises at least one switch electrically coupled with the fourth connector. A Z box may further comprise a group of circuits including an open circuit and a short circuit, each electrically coupled to the at least one switch. In some embodiments, a Z box may further comprise a null circuit. In some embodiments, a Z box may further comprise a known impedance circuit.

In some embodiment, a Z box has TSR connectors or RCA connectors. In some embodiments, a Z box uses test probes to connect to a device under test.

In some embodiments, a Z box used to measure the response of a device under test using a signal generated by an audio card comprises a first means for receiving a first signal from the audio card, a first means for transmitting the first signal to a device under test, a second means for receiving a second signal from the device under test, and a second means for transmitting the second signal to the audio card.

In some embodiments, a Z box further comprises a third means for transmitting the first signal to a null circuit and a third means for receiving the second signal from the null circuit. In some embodiments, a Z box further comprises a fourth means for transmitting the first signal to a short circuit and a fourth means for receiving the second signal from the short circuit. In some embodiments, a Z box further comprises a fifth means for transmitting the first signal to an open circuit and a fifth means for receiving the second signal from the open circuit. In some embodiments, a Z box further comprises a sixth means for transmitting the first signal to a known impedance circuit and a sixth means for receiving the second signal from the open circuit.

In some embodiments, a Z box further comprises a means for calculating a measurement of the device under test. In some embodiments, the measurement is an impedance measurement. In some embodiments, the measurement is a transfer function measurement.

In some embodiments, a method for analyzing the response of a device under test using a signal generated by an audio card comprises generating a first sound file. A first signal is then generated with the audio card where the first signal corresponds to the first sound file. The first signal is transmitted to a device under test through the Z box. A second signal is received from a device under test. The second signal is transmitted through the Z Box to the audio card, wherein the audio card converts and records the second signal as a second sound file.

In some embodiments, a method for analyzing the response of a device under test using a signal generated by an audio card further comprises comparing the second sound file to the first sound file to determine a measure of the device under test. In some embodiments, comparing the two sound files utilizes digital signal processing software or hardware.

In some embodiments, a method for analyzing the response of a device under test using a signal generated by an audio card further comprises making a short circuit measurement utilizing the first signal, and making an open circuit measurement utilizing the first signal. In some embodiments, a method for analyzing the response of a device under test using a signal generated by an audio card further comprises making a null circuit measurement utilizing the first signal. In some embodiments, a method for analyzing the response of a device under test using a signal generated by an audio card further comprises making a known impedance circuit measurement utilizing the first signal.

In some embodiments, a method for analyzing the response of a device under test using a signal generated by an audio card further comprises calculating an impedance measurement for the device under test based on the null circuit measurement, the short circuit measurement, the open circuit measurement, and a device under test circuit measurement.

In some embodiments, a method for analyzing the response of a device under test using a signal generated by an audio card further comprises calculating an impedance measurement for the device under test based on the known impedance circuit measurement, the short circuit measurement, the open circuit measurement, and a device under test circuit measurement.

In some embodiments, a method for analyzing the response of a device under test using a signal generated by an audio card further comprises calculating a phase.

In some embodiments, a method for analyzing the response of a device under test using a signal generated by an audio card has the first sound file represent a signal comprising a plurality of frequencies.

Further areas of applicability of the present disclosure will become apparent from the detailed description provided hereinafter. It should be understood that the detailed description and specific examples, while indicating various embodiments, are intended for purposes of illustration only and do not limit the scope of the disclosure.

In the appended figures, similar components and/or features may have the same reference label. Where the reference label is used in the specification, the description is applicable to any one of the similar components having the same reference label.

DETAILED DESCRIPTION

The ensuing description provides various embodiments only, and is not intended to limit the scope, applicability or configuration of the disclosure. Rather, the ensuing description of the embodiments will provide those skilled in the art with an enabling description for implementing an embodiment. It should be understood that various changes may be made in the function and arrangement of elements without departing from the spirit and scope as set forth in the appended claims.

In one embodiment, a Z box apparatus is used for testing the response of a device under test ("DUT") and may be connected to a sound card. The combined Z box and sound card may be used to measure the impedance of the DUT, such as a circuit, over various known frequencies. The Z box may receive a signal transmitted from the sound card. The Z box may be configured to transmit a signal of known frequency from the sound card to the DUT. The Z box may then receive a resulting signal from the DUT potentially with modified amplitude and phase. The Z box may transmit the resulting signal from the DUT to the sound card. In some embodiments, the Z box may transmit a signal from the sound card back to the sound card without transmitting the signal through the DUT. In some embodiments, the Z box may be configured such that the Z box may be calibrated using a variety of measurements using signals from the sound card. In some embodiments, the Z box may be calibrated using measurement tests selected from a group including: a null circuit test, an open circuit test, a short circuit test, and/or a known impedance circuit test.

I. Introduction

Embodiments provide apparatuses, systems, and methods for testing the response of device under test ("DUT") to signals from an audio card. Such DUTs may include, but are not limited to, components, devices, analog circuits, digital circuits, and/or sub-assemblies. Such audio cards may be referred to herein as "sound cards". Many off-the-shelf computers have a sound card already installed or built into the computer. In cases where a computer does not include a sound card when purchased, it is often easy to install a sound card or attach one to the computer. A sound card generally includes an analog to digital converter and a digital to analog converter. In addition, sound cards generally include a microphone and/or line input and a headphone and/or speaker output that one can connect to using common input and output connectors such as a mini plug/jack or RCA plug/jack. These attributes of a sound card installed in a computer allow for embodiments that provide inexpensive means for testing the response of a DUT to a signal from a sound card.

2. Apparatuses and Systems

Figure 1:
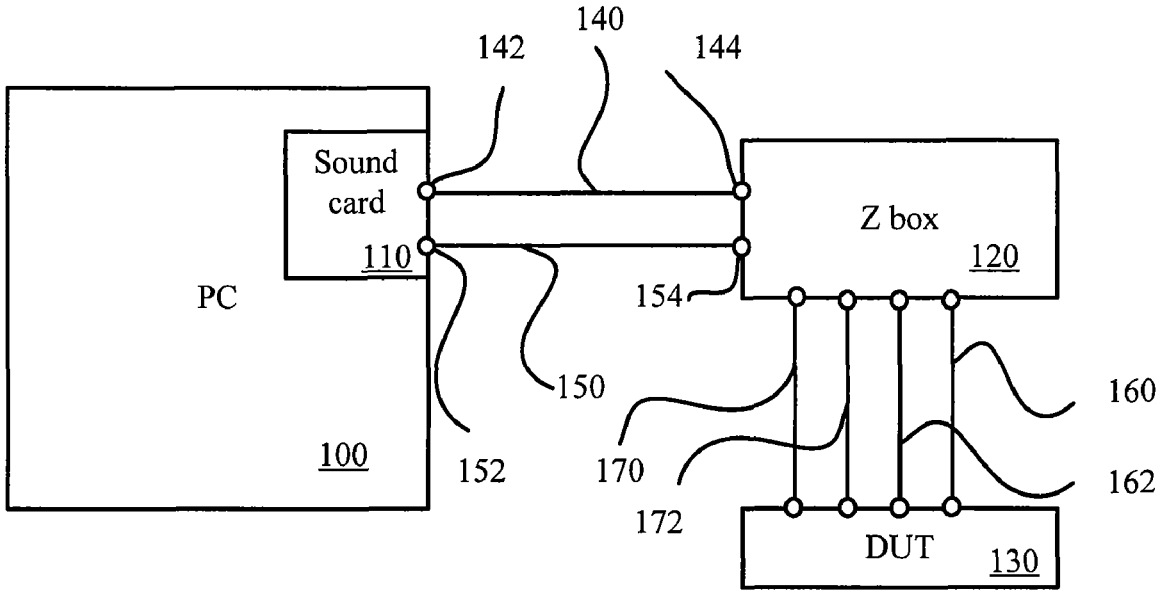
FIG. 1 provides a structural diagram of embodiments suitable for testing the response of a device under test ("DUT") to a signal from an audio card.

An overview of embodiments suitable for testing the response of a DUT to a signal from an audio card is provided in the structural diagram of FIG. 1. Testing of a DUT 130 may use signals generated by sound card 110 connected with computer 100. In one embodiment, signals are generated to provide a multi-frequency signal that test a DUT's 130 response to different frequencies. In another embodiment, signals are generated to provide a single frequency signal. For example, sound card 110 may generate sine wave signals ranging from 20 Hz to 20 KHz. Other sound cards may have ranges that are higher or lower. For example, a sound card may have a range from 5 Hz to 200 KHz. Sound card 110 may also vary the amplitude of each signal along with its frequency. As is well known, the phase of a signal may be a measure of how DUT 130 responds to a signal. Embodiments that make measurements of how DUT 130 alters, impedes, or changes signals in terms of amplitude and phase are both disclosed. For example, an impedance and/or a transfer function of DUT 130 may be determined based on how DUT 130 responds to a signal from sound card 110.

Figure 2:
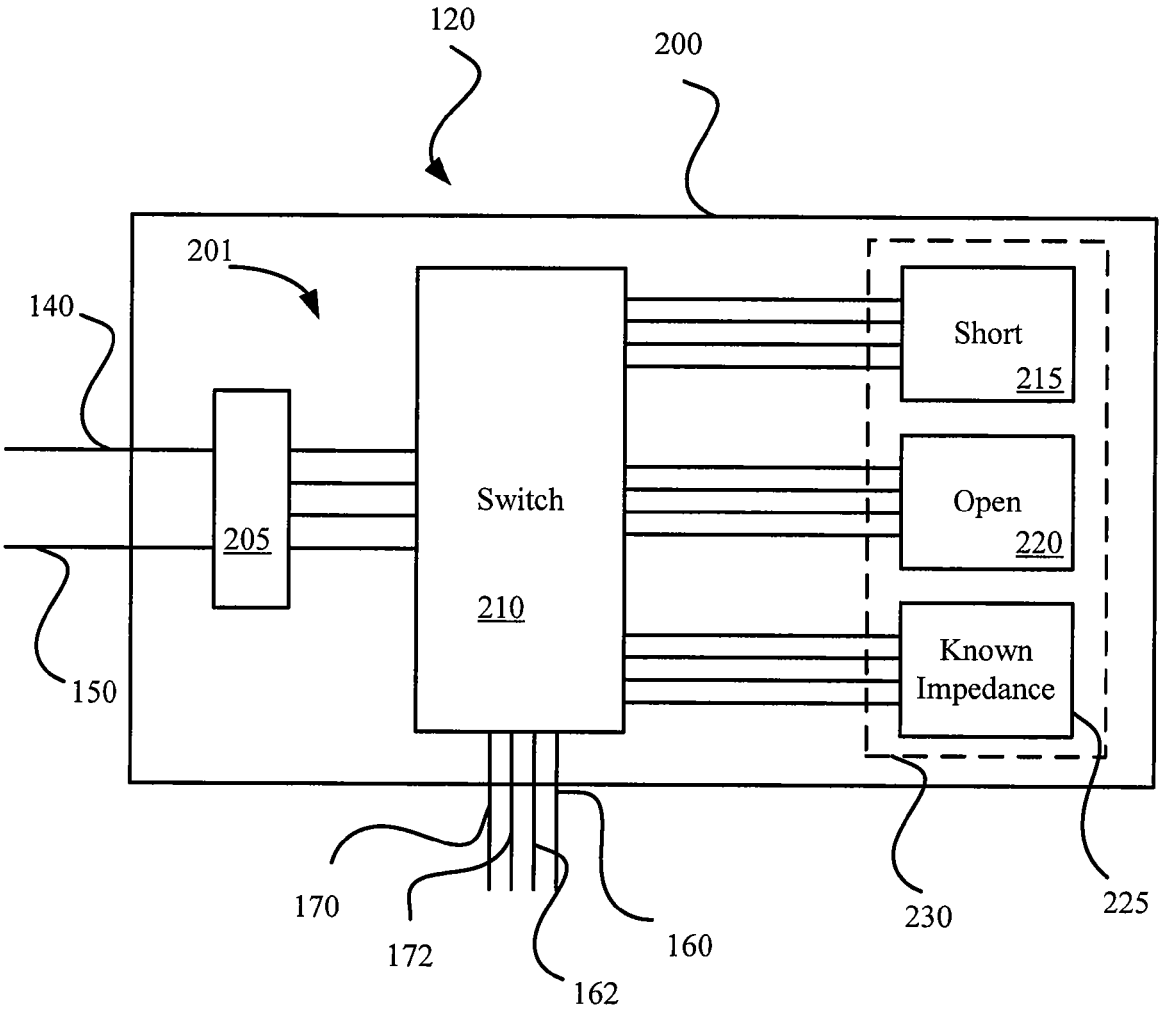
FIG. 2 provides a schematic diagram of embodiments of a Z box suitable for testing the response of a DUT to a signal from an audio card.

A signal generated by sound card 110 may be transmitted to DUT 130 using a series of components shown in FIG. 1, including Z box 120. Sound card 110 includes both a microphone/line in/input jack and a headphone/stereo/output jack. Z box input cable 140 connects from sound card output connector 142 of sound card 110 to Z box input connector 144 on Z box 120 for testing the response of DUT 130 to the signal from sound card 110. In some embodiments, Z box input cable 140 comprises a stereo cable. Z box input cable 140 may connect to sound card 110 using a connector as specified by the design of sound card 110 utilized. In some embodiments, Z box input cable 140 connects with sound card output connector 142 and Z box input connector 144 using, for example, a Tip, Ring, and Sleeve ("TSR") connector. TSR connectors may also be known as audio jacks, phone plugs, jack plugs, stereo plugs, mini-jacks, mini-plugs, or mini-stereo. In other embodiments, sound card output connector 142 and Z box input connector 144 may be an RCA plug or jack. In some embodiments, Z box input cable 140 connects to Z box 120 using a matching TSR or RCA connection. In other embodiments, Z box input cable 140 runs directly into Z box 120 and connects with the internal circuitry of Z box 120 as shown in FIG. 2 at 205. In other embodiments, Z box 120 directly connects using an audio connector to the sound card output connector 142. In some embodiments, a Z box input cable may include a mono cable.

Figure 3:
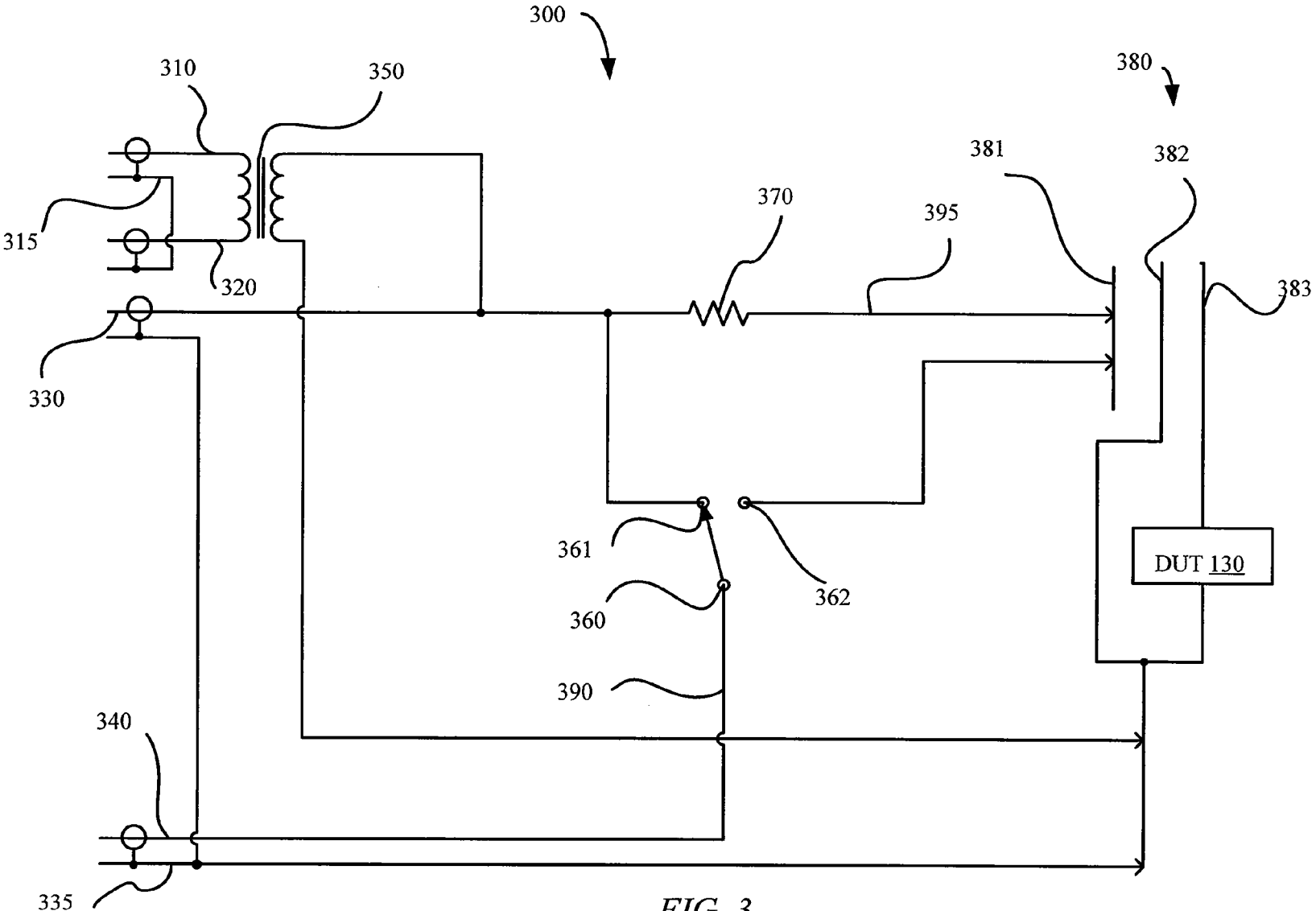
FIG. 3 provides a circuit diagram of an embodiment of a Z box suitable for testing the response of a DUT to a signal from an audio card.

Z box 120 comprises circuitry designed to facilitate the testing of DUT 130. Circuitry may be designed to facilitate transmitting of a signal from sound card 110 to DUT 130. Circuitry may also be designed to facilitate the calibration of Z box 120. FIGS. 2 and 3 provide more details regarding several embodiments.

From Z box 120, a signal may be transmitted through other connectors to DUT 130. In some embodiments, a first DUT input connector 160 and a second DUT input connector 162 comprise a test probe. In some embodiments, there may be a single DUT input connector; in other embodiments, there may be multiple DUT input connectors between Z box 120 and DUT 130. In some embodiments, DUT input connectors 160 and 162 may comprise cables. In one embodiment, DUT input connectors 160 and 162 may be connectors such as an audio connector such as a Tip, Ring, and Sleeve ("TSR") connector; TSR connectors may also be known as audio jacks, phone plugs, jack plugs, stereo plugs, mini-jacks, mini-plugs, or mini-stereo. In other embodiments, the cable connector may be an RCA jack. In some embodiments, DUT input connectors 160 and 162 connect to DUT 130 using a TSR or RCA connector. DUT input connectors 160 and 162 may be determined by the specific requirements of DUT 130.

Once a signal has passed through DUT 130, DUT output connectors may transmit a resulting signal back to Z box 120. In some embodiments, a first DUT output connector 170 and a second DUT output connector 172 comprise a test probe. In some embodiments, there may be a single DUT output connector. In other embodiments, there may be multiple connectors between Z box 120 and DUT 130. In general, DUT output connectors 170 and 172 may comprise connectors similar to DUT input connectors 160 and 162. In some embodiments, DUT input and output connectors 160, 162, 170, and 172 may include a four wire Kelvin configuration. In some embodiments, DUT input and output connectors 160, 162, 170, and 172 may include alligator clips.

In some embodiments, Z box output cable 150 may carry a resulting signal to sound card input connector 152 of sound card 110. In general, sound card input connector 152 and Z box output connector 154 may comprise similar structures and functions as sound card output connector 142 and Z box input connector 144. In general, Z box output cable 150 may comprise similar structures and functions as Z box input cable 140. In some embodiments, Z box output cable may comprise a mono cable.

Computer 100 may comprise any device having processing capability sufficient to analyze data received from sound card 110 in accordance with embodiments. For example, computer 100 may comprise a personal computer, a mainframe, or a laptop, whose mobility makes it especially convenient. Computer 100 may be configured to control each of the components comprised by Z box 120.

Figure 6:
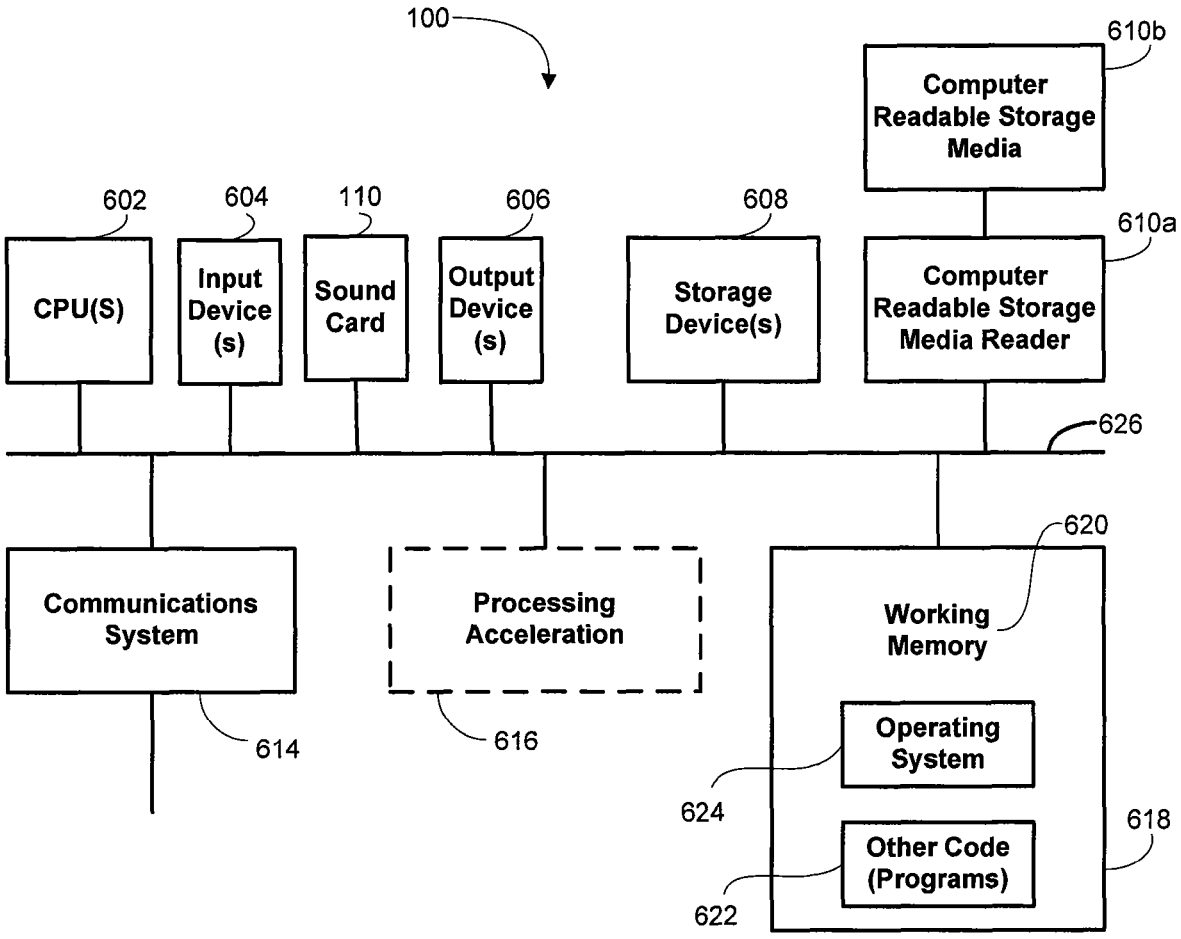
FIG. 6 provides a schematic diagram of a computer used in embodiments.

FIG. 6 provides a schematic illustration of a structural arrangement that may be used to implement computer 100 according to an embodiment. FIG. 6 broadly illustrates how individual elements of computer 100 may be implemented in a separated or more integrated manner. Computer 100 is shown comprised of hardware elements that are electrically coupled via bus 626, including a processor 602, an input device 604, an output device 606, a sound card 110, a storage device 608, a computer-readable storage media reader 610*a*, a communications system 614, a processing acceleration unit 616 such as a digital signal processor or special-purpose processor, and a memory 618. The computer-readable storage media reader 610*a* is further connected to a computer-readable storage medium 610*b*, the combination comprehensively representing remote, local, fixed, and/or removable storage devices plus storage media for temporarily and/or more permanently containing computer-readable information. The communications system 614 may comprise a wired, wireless, modem, and/or other type of interfacing connection and permits data to be exchanged with external devices as desired.

Computer 100 also may comprise software elements, shown as being currently located within working memory 620, including an operating system 624 and other code 622, such as a program designed to implement different embodiments. For example, computer 100 may include device drivers for operating and controlling audio card 110. In addition, computer 100 may utilize digital signal processing software elements. Furthermore, computer 100 may comprise software elements designed to allow a user to input parameters of interest in studying the response of DUT to a signal from audio card 110. Computer 100 may also include software elements designed to facilitate analyzing signals received from calibration and testing of DUT 130 in order to determine different measures of DUT 130. It will be apparent to those skilled in the art that substantial variations may be made in accordance with specific requirements. For example, customized hardware might also be used and/or particular elements might be implemented in hardware, software (including portable software, such as applets), or both. Further, connection to other computing devices such as network input/output devices may be employed. Connections between the computer 100 and the various components of Z box 120 may use any suitable connection, such as a parallel-port connection, a universal-serial-bus ("USB") connection, and the like.

In some embodiments, sound card 110 may comprise a computer expansion card that facilitates the input and output of audio signals to and from computer 100 under control of computer programs. In some embodiments, sound card 110 may provide the audio component for multimedia applications such as music composition, editing video or audio, presentation/education, and entertainment (games). In some embodiments, computer 100 may have sound capabilities built in, while in other embodiments, computer 100 may require additional expansion cards to provide for audio capability. In some embodiments, sound card 110 comes already installed on computer 100 when it is purchased. In some embodiments, sound card 110 is installed after purchases of computer 100. Sound card 110 may connect up to computer 100 in many ways, including but not limited to the following examples: PCI, ISA, USB, IEEE 1394, Parallel Port, PCI-E, or PCMIA connections. In some embodiments, sound card 110 may be directly integrated into computer 100. Sound card 110 may provide an output and input connection with different configurations as discussed throughout, including for example, but not limited to, TRS, RCA, and or DIN connectors. Sound card 110 may send output signals over a wide range of frequencies. For example, in some embodiments, sound card 110 may be capable of transmitting frequencies ranging from 20 Hertz to 20,000 Hertz. Other embodiments of sound card 110 may have higher and lower ranges. In some embodiments, sound card 110 may have a lower range such as 5 Hertz, while other embodiments may have a high range, such as 40,000 Hertz. Sound card 110 may sample input signals at a variety of sizes and rates. In some embodiments, sound card 110 may sample using 8 or 16 bit samples. In other embodiments, the bit sample size might be higher or lower, such as 32 bit samples for example. Merely by way of example, in some embodiments, sound card 110 may sample incoming signals from about 4000 to 44,000 samples per second. In some embodiments, sound card 110 may sample at higher or lower sampling rates, such as 48,000 samples per second, merely by way of example. In some embodiments, sound card 110 may send and/or receive mono signals. In some embodiments, sound card 110 may send and/or receive stereo signals.

An overview of some embodiments of Z box 120 suitable for testing the response of DUT 130 to a signal from audio card 110 is provided in the schematic diagram of FIG. 2. According to an embodiment, Z box 120 may include a housing 200, an interface unit 205, a switching unit 210, and calibration circuits 215, 220, 225, and 230, along with DUT input connectors 160 and 162 and DUT output connectors 170 and 172 connecting Z box 120 to DUT 130. Circuitry 201, switching unit 210, and circuits 215, 220, 225, and 230 may be used by the Z box 120 to transmit signals for the purpose of calibration and measuring the response of DUT to a signal from audio card 110. Switching unit 210 may be used to direct signals to different circuits, such as short circuit 215, open circuit 220, known impedance circuit 225, or other possible circuits or to DUT 130 itself in order to calibrate and measure the response of DUT 130 to a signal from audio card 110.

Z box 120 may comprise housing 200 in which circuitry 201 is housed suitable for testing the response of DUT 130 to a signal from audio card 110. Z box input cable 140 and Z box output cable 150 connect to circuitry 201 through housing 200. Z box input cable 140 and Z box output cable 150 may connect to housing 200 through connectors as described in more detail in FIG. 1.

Interface unit 205 may connect Z box input and output cables 140 and 150 to circuitry 201 of Z box 120. Z box input cable 140 may carry a signal from sound card 110 to Z box 120. Z box output cable 150 may carry a signal from Z box 120 to the sound card 110. In some embodiments, interface unit 205 may include a transformer. In some embodiments, a transformer may be used to transform a signal. Merely by way of example, a transformer may transform the amplitudes of a signal. In some embodiments, a transformer transforms an input signal. In some embodiments, a transformer transforms an output signal. In some embodiments, a transformer isolates circuitry 201 of Z box 120. In some embodiments, interface unit 205 includes an amplifier. In some embodiments, an amplifier amplifies an input signal. In some embodiments, an amplifier amplifies an output signal.

In some embodiments, interface unit 210 connects to switching unit 210. Switching unit 210 may control which circuits a signal is directed through. In some embodiments, switching unit 210 may be set to different settings depending on the nature of the measurements of DUT 130 being taken. For example, in one embodiment, the switching unit 210 may be set so that short circuit 215 is utilized. In one embodiment, switching unit 210 may be set so that open circuit 220 is utilized. In one embodiment, switching circuit 210 may be set so that known impedance circuit 225 is utilized. In one embodiment, switching unit may set a switch to create other possible circuits such as a null circuit.

In some embodiments switching unit 210 may also be electrically coupled with DUT input connectors 160 and 162 and DUT output connectors 170, and 172. Other DUT connectors may also exist. DUT input connectors such as 160 and 162 may carry a signal from switching unit 210 to DUT 130. DUT output connectors such as 170 and 172 may carry a resulting signal from DUT 130 back to switching unit 210. In some embodiments, DUT input and output connectors 160, 162, 170, and 170 are test probes. Other embodiments of the DUT input and output connectors 160, 162, 170, and 172 are more thoroughly described through the text associated with FIG. 1.

One skilled in the art will recognize that some embodiments are possible where the above mentioned switching and circuitry may be achieved by a user physically connecting different circuit configurations to achieve the same results without a switch unit. As such, in some embodiments, measurements utilizing an open circuit, a null circuit, a short circuit, a known impedance circuit, and/or a DUT circuit may be achieved by appropriate use of a four wire Kelvin configuration.

In some embodiments, switching unit 210 may transmit a resulting signal to audio card 110 through Z box output cable 150. The various means by which this may happen are more thoroughly described through the text associated with FIG. 1.

An embodiment of Z box 120 suitable for testing the response of DUT 130 to a signal from audio card 110 is provided in the circuit diagram of FIG. 3. Z box 120 comprises a housing 200. Housing 200 holds Z box circuitry 300 that may be designed to meet the needs for calibration and test measurements of DUT 130.

In some embodiments, Z box circuitry 300 comprises a plurality of connectors 310, 315, 320, 330, 335, and 340 designed to receive signals from an audio card and to transmit resulting signals back to an audio card. Connectors 310, 315, and 320 may receive a signal from the audio card; in general, connector 315 may represent a common ground while connectors 310 and 320 represent left and right channel signals respectively. Connectors 310, 315, and 320 may comprise structures similar to those found for the sound card output connector 142 and the Z box input connector 144 described in the text associated with FIG. 1. Connectors 310, 315, and 330 may be configured to carry a signal from the audio card into the housing.

Connectors 330, 335, and 340 in FIG. 3 may receive a resulting signal from Z box circuitry 300. Similar to connectors 310, 315, and 320, in some embodiments, connector 335 may represent a common ground while connectors 340 and 350 represent right and left channel signals respectively. Connectors 330, 335, and 340 may comprise structures similar to those found for sound card input connector 152 and Z box output connector 154 described in the text associated with FIG. 1. Connectors 330, 335, and 340 may be configured to carry a resulting signal from Z box 120 to sound card 110.

As discussed earlier, connectors 310, 315, 320, 330, 335, and 340 themselves may take numerous different forms; one skilled in the art would recognize there are many equivalent ways to fashion connectors for Z box 120. For example, but not to be construed as exhaustive, in some embodiments, connectors 310, 315, 320, 330, 335, and 340 may comprise a Tip, Ring, and Sleeve ("TSR") connector. TSR connectors are also known as audio jacks, phone plugs, jack plugs, stereo plugs, mini-jacks, mini-plugs, or mini-stereo. In other embodiments, the connectors may comprise an RCA plug or jack.

In some embodiments, Z box circuitry 300 may comprise transformer 350. In some embodiments, transformer 350 alters the voltage transmitted through Z box circuitry 300. In other embodiments, transformer 350 is used to isolate Z box circuitry 300. In some embodiments, transformer may also used in Z box circuitry 300 to transform a resulting signal before it is transmitted to audio card 110. In some embodiments, Z box circuitry 300 may comprise an amplifier to amplify a signal or a resulting signal. In some embodiments, the amplifier may provide different power levels to a help test DUT 130. Merely by way of example, an amplifier may provide power of a few watts or even less; other amplifiers may provide higher powers reaching tens of kilowatts or even higher. In some embodiments, an amplifier may provide currents to help test DUT 130. Merely by way of example, an amplifier may provide currents of less than an amp; some amplifiers may provide high currents over ten amps or even higher.

In some embodiments, Z box circuitry 300 may comprise switch 360. In FIG. 3, the switch 360 may be set at different positions 361 and 362. In some embodiments, position 361 may be used to conduct a null circuit measurement. In some embodiments, position 362 may be used to conduct a short circuit measurement. In some embodiments, position 362 may be used to conduct an open circuit measurement. In some embodiments, position 362 may be used to conduct a DUT measurement.

In some embodiments, Z box circuitry 300 may comprise known impedance 370. In some embodiments, known impedance 370 may be a resistor. In other embodiments, impedance 370 may be another well know impedance such as a capacitor, an inductor, or generalized impedance components, circuits, or devices. In general, known impedance 370 may include active and or passive components.

In some embodiments, Z box circuitry 300 may comprise switch 380 with a plurality of possible positions such as first position 381, second position 382, and third position 383 utilized for different calibration and DUT measurements. Switch 380 set in first position 381 may be utilized to conduct a null circuit measurement or an open circuit measurement. In second position 382, switch 380 may be utilized to conduct a short circuit measurement. In third position 383, switch 383 may be utilized to conduct a device under test measurement. In one embodiment, Z box circuitry 300 may utilize a configuration similar to switch 380 using test probes. In one embodiment, a null measurement circuit may be configured with sense line 390 connected to the positive side of impedance 370. This may be achieved with switch 360 connected to switch point 361. Source line 395 may then be left disconnected as seen with source line's 395 connection to switch point 381. In one embodiment, an open measurement circuit may be configured with sense line 390 connected with switch 360 connected with switch point 362. Source line 395 and sense line 390 may then be connected together as seen at switch point 381. In one embodiment, a short measurement circuit may be configured with sense line 390 connected with switch 360 connected with switch point 362. Source line 395 and sense line 390 may then be connected together as seen at switch point 382, which then connects both sense line 390 and source line 395 to a negative side of DUT 130. In one embodiment, a short measurement circuit may be configured with sense line 390 connected with switch 360 connected with switch point 362. Source line 395 and sense line 390 may then be connected together as seen at switch point 383, which then connects both sense line 390 and source line 395 to a positive side of DUT 130. One skilled in the art will recognize that the configurations using switch 380 and switch points first position 381, second position 382, and third position 383 may also be achieved using test probes and/or alligator clips that may be left unconnected, may be connected together, or may be connected to DUT 130 on a positive and a negative side to achieve comparable results. In some embodiments, these configurations would be achieved with a four wire Kelvin configuration. One skilled in the art would also recognize there are numerous equivalent ways to build this circuit to achieve the similar results.

One of ordinary skill in the art would realize that there are many ways to design the circuitry 300 of Z box 120 in order to achieve the result of testing the response of DUT 130 to a signal generated by audio card 110. In some embodiments, circuitry 300 may be designed to test the impedance of DUT 130. In other embodiments, circuitry 300 may be designed to measure a transfer function for DUT 130.

Figure 7:
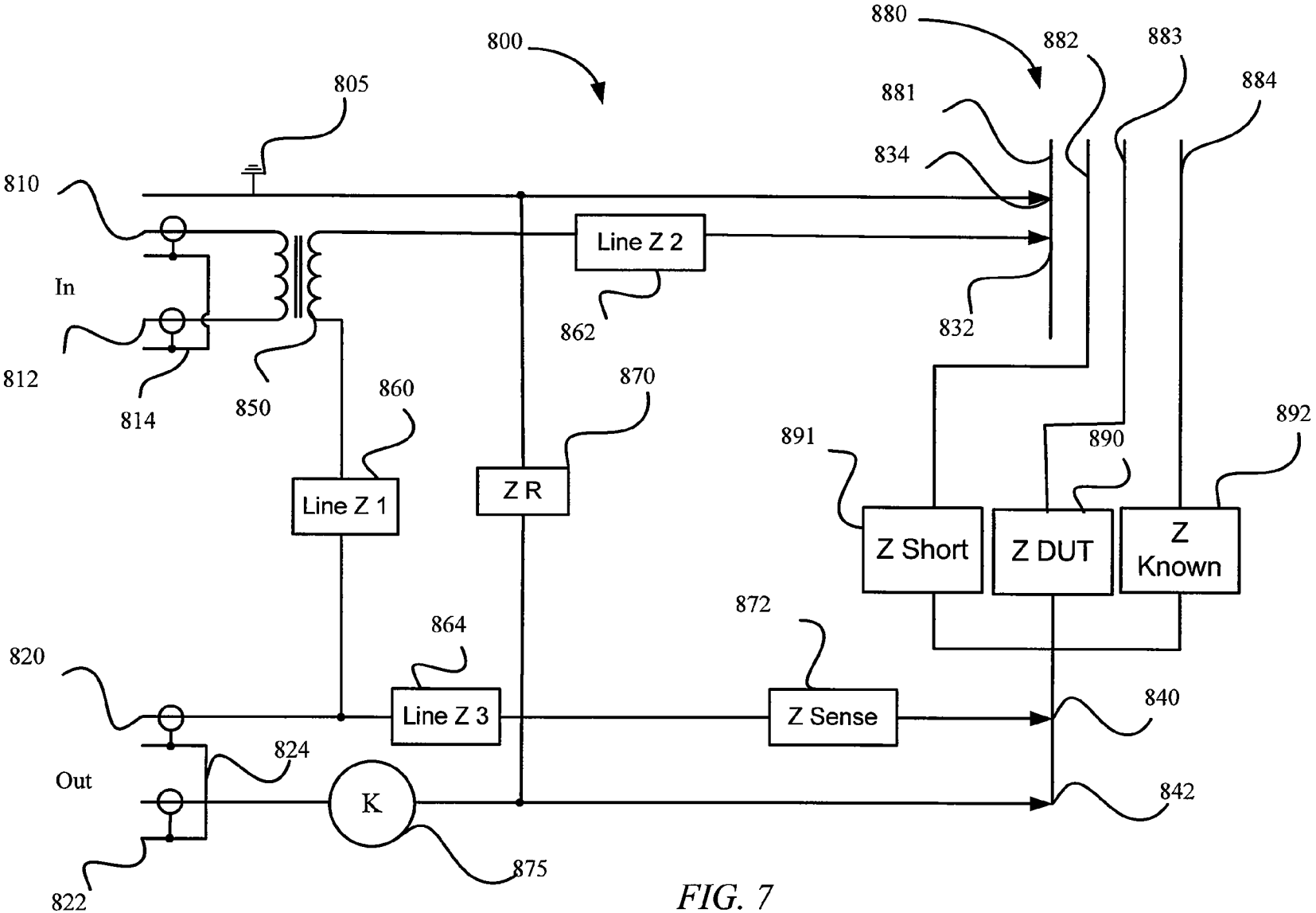
FIG. 7 provides a circuit diagram of an embodiment of a Z box suitable for testing the response of a DUT to signal from an audio card.

An embodiment of Z box 120 suitable to testing the response of DUT 130 to a signal from audio card 110 is provided in the circuit diagram of FIG. 7.

Within FIG. 7, Z box circuitry 800 may include connectors such as 810, 812, and 814, which provide input connections into the Z box circuitry, and connectors 820, 822, and 824, which provide output connections from the Z box 120. In some embodiments, these connectors would comprise stereo connectors; in other embodiments, these connectors would include mono connectors. Z box circuitry 800 may also include a transformer 850. Some embodiments may include an amplifier.

In some embodiments, Z box circuitry 800 may include a switch 880, allowing for different calibration and DUT tests. Those calibration or DUT tests may include an open test switch setting 881; a short test switch setting 882, a DUT test switch setting 883, a known impedance test switch setting 884. In some embodiments, a short test may be associated with a short impedance 891. In some embodiments, a DUT test may be associated with a DUT impedance 890. In some embodiments, a know impedance test may be associated with a know impedance 892. In some embodiments, the connectors 832, 834, 840, and 842 that help facilitating the calibration and DUT tests may comprise a four wire Kelvin configuration that may be used in conjunction with switch 880 or in place of switch 880, yet allowing for the same types of calibration and DUT testing. In some embodiments, Z box circuitry 800 may be configured to connect to a shield 805; in some embodiments, shield 805 may be a ground.

In some embodiments, Z box circuitry 800 includes a reference impedance 870 and a sense impedance 872. These impedance components may comprise active or passive components. Z box circuitry 800 also may include different lines which introduce impedance into the circuitry that may need to be taken into account of when making calibration measurements or DUT test measurements. For example, in some embodiments, there may be line impedances such as 860, 862, and 864. In some bases, other line impedances may need to be taken into account based on the specific circuitry used.

In some embodiments, as discussed under the Method sections below, a circuit constant K 875 may be determined from calibration tests that helps compensate for gain differences between different channels or reference and sense lines as discussed below.

In some embodiments, variations of the above disclosed embodiments may be used to provide calibration of Z box 120 and/or provide measures of DUT 130, but also provide calibration and measurements of audio card 110. In addition, in some embodiments, variations on Z box 120 circuitry can provide information and measurements of different lines and/or connectors coupled with or part of part of Z box 120 circuitry.

One of ordinary skill in the art would realize that there are many ways to design the circuitry 800 of Z box 120 in order to achieve the result of testing the response of DUT 130 to a signal generated by audio card 110. In some embodiments, circuitry 800 may be designed to test the impedance of DUT 130. In other embodiments, circuitry 300 may be designed to measure a transfer function for DUT 130.

3. Methods

Figure 4:
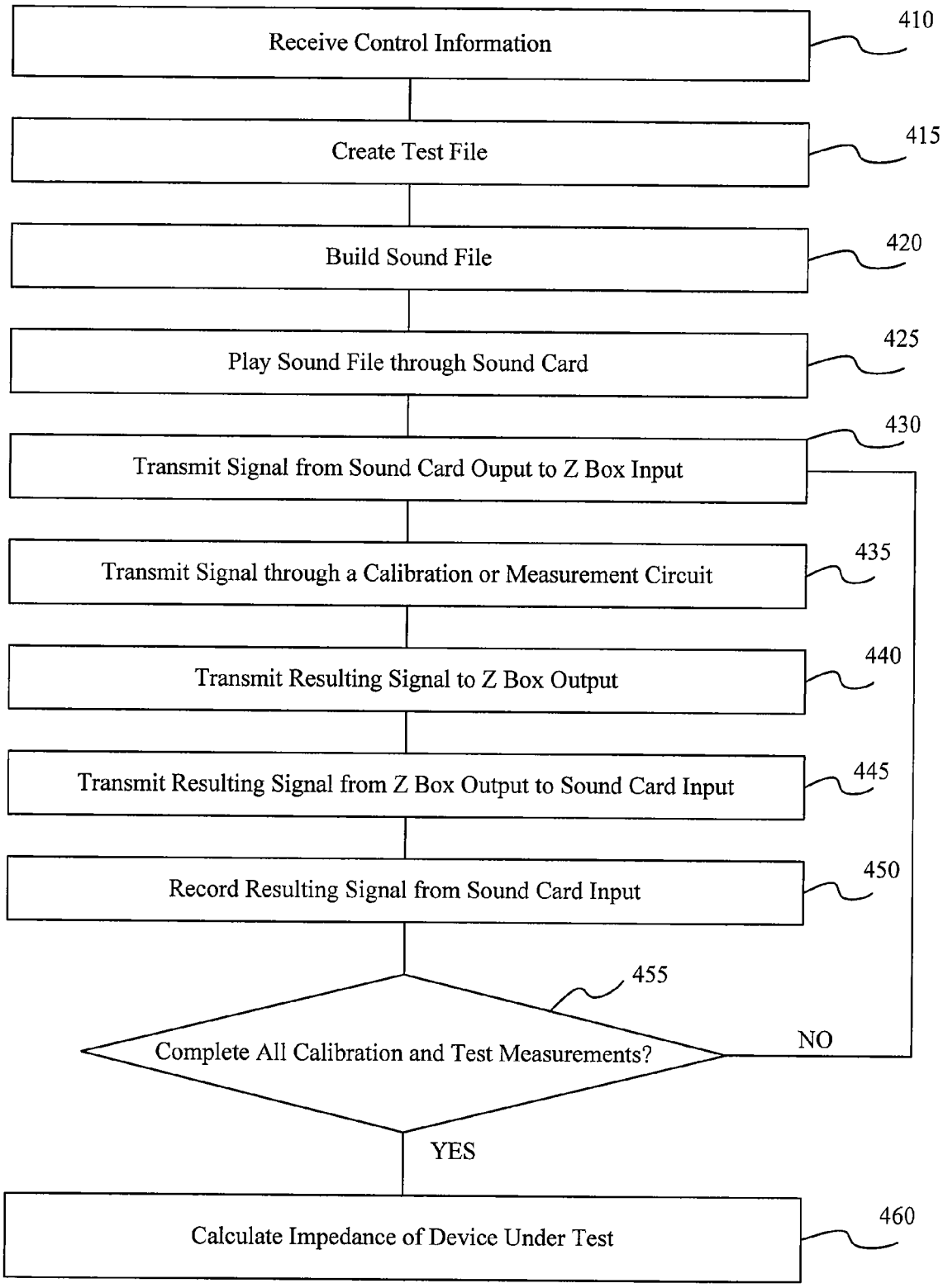
FIG. 4 provides a flow diagram illustrating a method for analyzing the response of a DUT using a signal generated by an audio card.

Embodiments may be used for testing the response of DUT 130 to a signal from audio card 110 using stimulus and response techniques. Stimulus and response techniques may be used to measure both calibration and DUT measure functions. FIG. 4 provides a flow diagram illustrating an embodiment of a method for analyzing the response of DUT 130 using a signal generated by audio card 110.

At block 410, a set of control information is received from a user. Control information allows a user to determine a set of parameters that will facilitate calibrating and measuring DUT 130. In one embodiment, a user enters control information into computer 100, creating a text file at block 415, which computer 100 reads. Control information may comprise parameters such as a start frequency, a stop frequency, a number of points to be measured, and/or an averaging array size. In some embodiments, control information may comprise a low frequency. In some embodiments, control information may comprise a high frequency. In some embodiments, control information may comprise an interval that may designate a frequency step that may be taken from a low to a high frequency. In some embodiments, control information may comprise a log frequency sweep. In some embodiments, control information may comprise a phase adjustment. In some embodiments, phase adjustment may be in float degrees. In some embodiments, control information may comprise a signal amplitude. In some embodiments, signal amplitude may be a float with a range between 0 and 1. In some embodiments, control information may comprise a minimum number of sample points. In some embodiments, control information may comprise an additional number of stimulus periods for each frequency. In some embodiments, control information may comprise a sample rate of the sound card 110. In some embodiments, control information may comprise a deadzone. In some embodiments, a deadzone may be an integer period in samples surrounding a marker. In some embodiments, control information may comprise a PCM. In some embodiments, a PCM may be an output level of sound card 110. In some embodiments, output level of soundcard 110 may be an integer between 0 and 31. In some embodiments, PCM may affect a marker size. In some embodiments, control information may comprise a ratio threshold. In some embodiments, ratio threshold may comprise a float step size before using an automatic stabilizing period. In some embodiments, control information may comprise information regarding a resistance used in a calibration. In some embodiments, control information may comprise information to put a sound card 100 left and right output one hundred eight degrees out of phase with each other.

At block 410, in some embodiments, control information may comprise a shape variable. In some embodiments, a shape variable may comprise a constant voltage variable. In some embodiments, a shape variable may comprise a proportional frequency. In some embodiments, a proportional frequency variable may comprise an output frequency divided by a high frequency. In some embodiments, a shape variable may comprise an inverse frequency variable. In some embodiments, an inverse frequency variable may comprise a low frequency divided by an output frequency. In some embodiments, a shape variable may comprise a square root frequency variable. In some embodiments, a square root frequency variable may comprise a square root of a output frequency divided by a high frequency. In some embodiments, a shape variable may comprise a square root of a frequency inverse variable. In some embodiments, a square root of a frequency inverse variable may comprise a square root of a low frequency divided by an output frequency.

At block 420, a sound file may be built based on a set of control information in a text file. At block 425, a sound file may be played or executed utilizing computer 100 interfaced with audio card 110. A sound file may comprise a synchronization signal. In some embodiments, a synchronization signal may be at the beginning of sound file. In some embodiments, a sound file may comprise a short period of silence before an actual stimulus or a test signal is executed.

At block 430, the signal generated by sound card 110 is transmitted to an Z box 120, designated generally as the Z box. Once the signal is received at Z box 120, the signal may be transmitted through a variety of different circuits at block 435. Circuitry may facilitate different calibration or measurement functions. In one embodiment, a first circuit may comprise a null circuit. In one embodiment, a second circuit may comprise a short circuit. In one embodiment, a third circuit may comprise an open circuit. In one embodiment, a fourth circuit may comprise a circuit with a known impedance. In one embodiment, a fifth circuit may comprise a circuit comprising a DUT 130. One skilled in the art would recognize that other circuits are possible depending on the specific measurements and calibration requirements for testing DUT 130.

After a signal from sound card 110 passes through circuitry as in block 435, a resulting signal may be transmitted to output connectors of Z box 120 as seen in block 440. At block 445, the resulting signal may be transmitted from Z box 120 to sound card 110 through Z box output cable 150. At block 450, sound card 110 may convert the resulting signal as an analog signal into a digital format that may then be recorded. In some embodiments, the resulting signal may be dithered.

At block 455, a decision may be made as to whether to continue transmitting signals to Z box 120 based on whether all the calibration and test measurements have been completed. If more measurements may be desired or required, sound file may be played again at block 425, continuing through the flow chart until one is ready to end.

At block 460, a calculation may be made using recorded information from calibration and test measurements to calculate a measure of DUT 130. In one embodiment, a measure of DUT 130 may be of an impedance of DUT 130. In one embodiment, a measure of DUT 130 may be of a transfer function of DUT 130.

In one embodiment exemplified through the use of circuitry 300 found in FIG. 3, an impedance measure of DUT 130 may be calculated using the method of FIG. 4.

In some embodiments, a null circuit measurement may be taken to correct for gain differences between different channels from Z box 120. In some embodiments, a null circuit measurement may be done where sense line 390 is connected to the positive terminal side of impedance 370. Null circuit measurement may be achieved utilizing switch 360 in position 361; source line 395 may be left disconnected. A signal may then be sent from sound card 110 through the Z box 120 and a resulting signal then sent back to sound card 110. Sound card 110 and/or computer 100 record values received from the connector 330 carrying a left channel signal, referred to as left_in. Sound card 110 and/or computer 100 also record values received from the connector 340 carrying a right channel signal, referred to as right_in. In some embodiments, values left_in and right_in represent voltages. Computer 100 may then calculate a constant K' that may correct for the gain difference between the left and right channels or a reference line and a sense line. K' may be calculated using a formula:

$$K' = \frac{\text{left_in}}{\text{right_in}}.$$

In some embodiments as in FIG. 3 with the method of FIG. 4, an open circuit measurement may be made where an open measurement may measure a total impedance exhibited by a right input line or a sense line 390. In some embodiments, a right channel is a measure channel, while a left channel is a monitor channel. A right channel or measure channel is connected to DUT 130 in some embodiments. In some embodiments, a monitor channel monitors what is being sent into a sense resistor, or impedance 370. In one embodiment, an open circuit may be formed where source line 395 and sense line 390 are connected to each other and nothing else. Open circuit measurement may be achieved utilizing switch 360 in position 362 and switch 380 in position 381. A signal may then be sent from sound card 110 through the Z box 120 and a resulting signal then sent back to sound card 110. Sound card 110 and/or computer 100 record values received from the connector 330 carrying a left channel signal, referred to as left_open. Sound card 110 and/or computer 100 also record values received from the connector 340 carrying a right channel signal, referred to as right_open. In some embodiments, values left_open and right_open represent voltages. Computer 100 may then calculate an impedance for the right input or sense line 390, herein referred to as Z_right. Z_right may be calculated using K' and formula:

$$\text{Z_right} = \frac{R_S}{\text{left_open} - (\text{right_open} \times K')} - R_S,$$

where $R_S$ is an impedance value associated with an impedance 370. In some embodiments, $R_S$ is a sense resistor value.

In some embodiments as in FIG. 3 with the method of FIG. 4, a short circuit measurement may be made that measures a stray impedance of Z box 120. A short circuit may be made by connecting both source line 395 and sense line 390 to a negative terminal side of DUT 130. In some embodiments, this may be achieved by utilizing switch 360 in position 362 and switch 380 in position 382. Source line 395 and sense line 390 may be connected to negative side of DUT 130. A signal may then be sent from sound card 110 through the Z box 120 and a resulting signal then sent back to sound card 110. Sound card 110 and/or computer 100 record values received from the connector 330 carrying a left channel signal, referred to as left_short. Sound card 110 and/or computer 100 also record values received from the connector 340 carrying a right channel signal, referred to as right_short. In some embodiments, values left_short and right_short represent voltages. Computer 100 may then calculate multiple impedances associated with a short circuit. A first impedance Z_short_total may be calculated using K' and formula:

$$\text{Z_short_total} = \frac{R_S}{\text{left_short} - (\text{right_short} \times K')} - R_S$$

where $R_S$ is an impedance value associated with an impedance 370. In some embodiments, $R_S$ is a sense resistor value. A second impedance Z_short may be calculated using a formula using previously calculated values Z_short_total and Z_right:

$$\text{Z_short} = \frac{1}{\frac{1}{\text{Z_short_total}} - \frac{1}{\text{Z_right}}}.$$

In some embodiments as in FIG. 3 with the method of FIG. 4, a DUT circuit measurement may be made to now test DUT 130. A DUT circuit may be made by connecting source line 395 and sense line 390 to positive terminal side of DUT 130. DUT circuit measurement may be achieved utilizing switch 360 in position 362 and switch 380 in position 383. A signal may then be sent from sound card 110 through the Z box 120 and DUT 130 and a resulting signal then sent back to sound card 110. Sound card 110 and/or computer 100 record values received from the connector 330 carrying a left channel signal, referred to as left_capture. Sound card 110 and/or computer 100 also record values received from the connector 340 carrying a right channel signal, referred to as right_capture. In some embodiments, values left_capture and right_capture represent voltages. Computer 100 may then calculate an impedance for DUT 130, referred to as Z_load, using previously calculated values Z_short, Z_right, and K':

$$\text{Z_load} = \frac{1}{\frac{1}{\frac{R_S}{\text{left_capture} - (\text{right_capture} \times K')} - R_S} - \frac{1}{\text{Z_right}}} - \text{Z_short}$$

where $R_S$ is an impedance value associated with an impedance 370. In some embodiments, $R_S$ is a sense resistor value.

For each of these measurements, a method as disclosed runs at the sound file of block 420, sweeping the frequencies contained with the sound file. Measurements may be made at each discrete stimulus frequency in the sound file, with the resulting data stored in a matrix of complex numbers. In some embodiments, dithering may be used before quantization of the received signals to avoid quantization distortion.

In some embodiments, a known impedance may be used to help calibrate Z box 120 and to determine different measures of DUT 130. FIG. 7 presents one embodiment that may utilize a known impedance 892 for calibration and measurement purposes. A known impedance such as 892 may also be used in embodiments like those seen in FIG. 3. Comparable impedance calculations as disclosed above based on measuring signals received on one channel or on two separate channels such as 820 and 822 may be used to calibrate the Z box circuitry 800 and make measurements of DUT 890. As disclosed above, making measurements of signals received on channels utilizing a combination of measurements such as an open circuit measurement using circuit 881, a short circuit measurement using circuit 882, a known impedance circuit measurement using circuit 884, and a DUT circuit measurement using circuit 883 may be used to calibrate Z box circuitry 880 and make measurements of DUT 890. Using these measurements, one skilled in the art may calculate impedances for DUT 890. In some embodiments, these measurements may be used to determine a transfer function.

One skilled in the art would realize there are other equivalent ways to make these calculations utilizing the circuitry disclosed in FIG. 1, FIG. 2, FIG. 3, FIG. 4, FIG. 5, FIG. 6, FIG. 7, and elsewhere in the Application. In additional, the apparatuses, methods, and systems disclosed may be set up to perform many different well-known calibration techniques.

Figure 5:
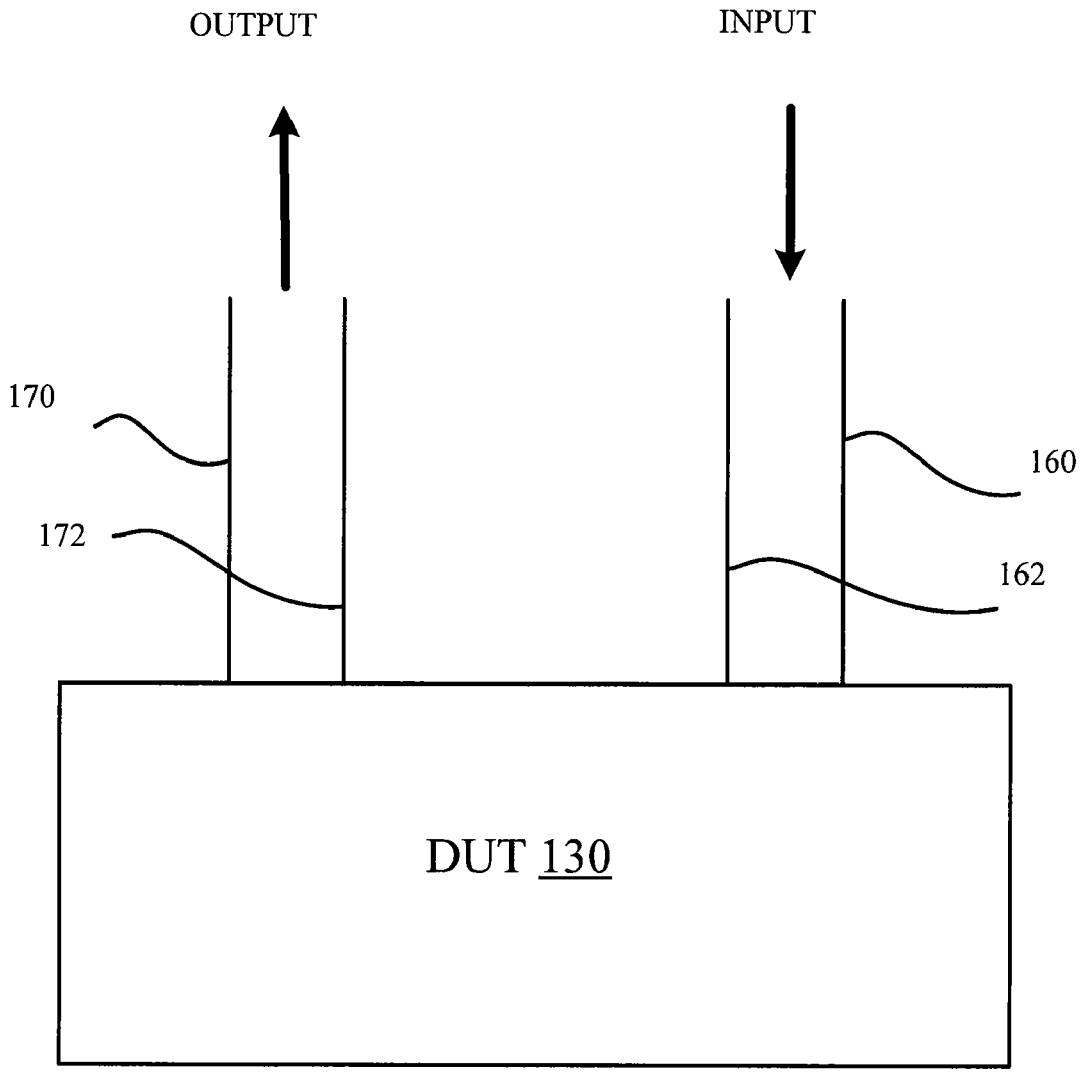
FIG. 5 provides a schematic diagram of a DUT and connectors to show a generalized approach to making measurements of the response of the DUT to a signal from an audio card.

Additional measurements of the response of DUT 130 to a signal from audio card 110 are possible within the spirit of the embodiments. FIG. 5, for example, comprises a figure focused on DUT 130 to show a generalized approach to making measurements of the response DUT 130 to a signal from audio card 110.

FIG. 5 shows two DUT input connectors 160 and 162 that may deliver signals to DUT 130. FIG. 5 also shows two DUT output connectors that may deliver resulting signals from DUT 130. DUT input connectors 160 and 162 and DUT output connectors 170 and 172 are electrically coupled with Z box 120, computer 100, and sound card 120 as disclosed in FIG. 1, FIG. 2, and FIG. 3. FIG. 5 is drawn, merely by way of example, to emphasize that DUT 130 generally receives signals and then transmits resulting signals. From the signals delivered through DUT input connectors 160 and 162, different measures of DUT 130 may be determined and calculated utilizing methods such as those shown in FIG. 4 with modifications to circuitry such as 201 or 300 and a set of control information and source code utilized to build, record, and analyze the sound files. In some embodiment, a transfer function H may be calculated using such a configuration. For example, an input voltage $V_{IN}$ may be delivered through DUT input connectors 160 and 162 to DUT 130. An output voltage $V_{OUT}$ may then be delivered from DUT 130 to DUT output connectors 170 and 172. $V_{IN}$ and $V_{OUT}$ may be functions of frequency f or angular frequency w. A transfer function H may then be calculated for DUT 130 based on the formula:

$$H(w) = \frac{V_{OUT}(w)}{V_{IN}(w)}.$$

One skilled in the art would recognize that the formula may be used to express a complex measure of DUT 130. In some embodiments, a transfer function H(w) may help describe DUT 130 comprising both reactive and nonreactive elements. Transfer function H(w) comprises both real and complex parts to it, representing both amplitude and phase changes induced by the DUT 130. In general, magnitude of H(w) and phase of H(w) may be calculated using the following formulas involving real and imaginary parts of H, Re H and Im H respectively:

$$|H| = ((\mathrm{Re}H)^2 + (\mathrm{Im}H)^2)^{1/2}$$

$$\arg(H) = \tan^{-1}\left(\frac{\mathrm{Im}H}{\mathrm{Re}H}\right) = \phi.$$

In some embodiments, transfer function H(w) may provide useful methods for measuring the response of DUT 130 to signals from audio card 110 for different types of DUT including, but not limited to, servo systems and transducers.

Apparatuses, methods, and systems disclosed as directed at measuring the response of DUT 130 to a signal from audio card 110 provide many improving features. The use of an audio card to both send and receive signals that have passed through a device under test may provide an inexpensive alternative to standard scalar and network analyzers. A sound card can send and receive audio at the same time. A sound card can provide high resolution data. A sound card can be accurate, fast, and cheap. A sound card can use inexpensive linkages figures. And the power of a signal from a sound card may also be increased using an amplifier.

The use of a sound card to test the response of a DUT to a signal from the sound cards may provide other advantages and improvements. A typical sound card may produce frequencies ranging from 20 Hz to 20 kHz. Some sound cards may have higher and lower frequency capabilities. These limits may be bypassed also, for example, down to a direct circuit signal. A sound card can provide sine wave outputs, while least square fit of a sine wave can be useful in rejecting maximums. Furthermore, using a sound card may allow one to send multiple frequencies without compromising speed. With a sound card, one may measure both amplitude and phase of signals, while also measuring multiple frequencies.

The use of a sound card to test the response of a DUT to a signal from the sound card may provide other advantages and improvements. For example, in some cases, all of the samples recorded by a sound card for each stimulus frequency may be used when analyzing the response of the DUT 130. This may be the case even when there are only a few samples per cycle. This may be accomplished by slightly dithering the individual stimulus frequencies from the original calculations such that the recorded samples may be interleaved back into an averaging array. The averaging array may represent one cycle or zero to three hundred sixty degrees whose amplitude and phase matches that of a recorded response.

Another advantage and improving feature of some embodiments of this invention is that a frequency step in the stimulus may occur as a wave crosses a zero. This may insure that voltage spikes are minimized.

Another advantage and improving feature of some embodiments of this invention is that averaging may be done by using a least squares fit of a sine wave. This means that averaging may be done on the samples themselves. This may greatly improve the dynamic range and speed factors. With respect to the dynamic range, for example, a system's dynamic range may theoretically be improved by $20*\mathrm{Log}(\sqrt{(\mathrm{Nsamples})})$. This improvement is 37 dB for 4800 sample points. With respect to speed, for example, if a user requests 50 frequencies to be analyzed at 48000 samples per second into a 4800 sample point array, the total analysis time may be as small as 5 seconds. In some embodiments, the sweep time may be slightly longer because a few extra cycles of stimulus should be used per stimulus frequency to allow a low damping factor DUT to stabilize after a frequency change.

Another advantage and improving feature of some embodiments as discussed before is cost. Most off-the-shelf personal computers come with a sound card that has suitable inputs and outputs for this invention. In addition, the Z boxes disclosed includes few parts with low total costs.

Having described several embodiments, it will be recognized by those of skill in the art that various modifications, alternative constructions, and equivalents may be used without departing from the spirit of the invention. Accordingly, the above description should not be taken as limiting the scope of the invention, which is defined in the following claims.

What is claimed is:

1. An apparatus for analyzing the response of a device under test using a signal generated by an audio card, comprising:

a housing;

a first connector coupled to the housing and configured to couple electrically with an output of the audio card and to receive a first signal from the audio card;

a second connector being electrically coupled with the first connector and configured to interface with the device under test in order to transmit the first signal to a device under test;

a third connector configured to receive a second signal from the device under test;

a fourth connector being electrically coupled with the third connector and configured to transmit the second signal to an input of the audio card;

at least one switch electrically coupled with the fourth connector; and at least one of a null circuit, a short circuit, an open circuit, or a known impedance circuit electrically coupled to the at least one switch.

2. The apparatus as in claim 1, further comprising a transformer electrically coupled with the first connector.

3. The apparatus as in claim 1, further comprising an amplifier electrically coupled with the first connector.

4. The apparatus as in claim 1, wherein the second connector and the third connector further comprise a four wire Kelvin configuration.

5. The apparatus as in claim 1, wherein the first connector is a TSR connector.

6. The apparatus as in claim 1, wherein the first connector is an RCA connector.

7. The apparatus as in claim 1, wherein the second connector is a test probe.

8. An apparatus for analyzing the response of a device under test using a signal generated by an audio card, comprising:

a first means for receiving a first signal from the audio card;

a first means for transmitting the first signal to a device under test;

a second means for receiving a second signal from the device under test;

a second means for transmitting the second signal to the audio card;

a third means for transmitting the first signal to a short circuit;

a third means for receiving the second signal from the short circuit;

a fourth means for transmitting the first signal to an open circuit; and a fourth means for receiving the second signal from the open circuit.

9. The apparatus as in claim 8, further comprising:

a fifth means for transmitting the first signal to a null circuit; and a fifth means for receiving the second signal from the null circuit.

10. The apparatus as in claim 8, further comprising:

a sixth means for transmitting the first signal to a known impedance circuit; and a sixth means for receiving the second signal from the open circuit.

11. The apparatus as in claim 8, further comprising:

a means for calculating a measurement of the device under test.

12. The apparatus as in claim 11, wherein the measurement is an impedance measurement.

13. The apparatus as in claim 11, wherein the measurement is a transfer function measurement.

14. A method for analyzing the response of a device under test using a signal generated by an audio card, comprising:

generating a first sound file;

generating a first signal with the audio card where the first signal corresponds to the first sound file;

transmitting the first signal to the device under test through a Z box;

receiving a second signal from the device under test; and transmitting the second signal through the Z box to the audio card, wherein the audio card converts and records the second signal as a second sound file.

15. The method as in claim 14, further comprising comparing the second sound file to the first sound file to determine a measure of the device under test.

16. The method as in claim 15, wherein comparing the second sound file to the first sound file to determine a measure of the device under test comprises digital signal processing.

17. The method as in claim 14, further comprising:

making a short circuit measurement utilizing the first signal; and making an open circuit measurement utilizing the first signal.

18. The method as in claim 17, further comprising making a null circuit measurement utilizing the first signal.

19. The method as in claim 18, further comprising calculating an impedance measurement for the device under test based on the null circuit measurement, the short circuit measurement, the open circuit measurement, and a device under test circuit measurement.

20. The method as in claim 17, further comprising making a known impedance circuit measurement utilizing the first signal.

21. The method as in claim 20, further comprising calculating an impedance measurement for the device under test based on the known impedance circuit measurement, the short circuit measurement, the open circuit measurement, and a device under test circuit measurement.

22. The method as in claim 14, further comprising calculating a phase.

23. The method as in claim 14, wherein the first sound file represents a signal comprising a plurality of frequencies.

* * * * *